US010988350B2

(12) United States Patent
Rondeel et al.

(10) Patent No.: US 10,988,350 B2
(45) Date of Patent: Apr. 27, 2021

(54) COMPENSATING DEVICE FOR MAINTAINING SPECIFIABLE TARGET POSITIONS OF A HOISTED LOAD

(71) Applicant: HYCOM B.V., Apeldoorn (NL)

(72) Inventors: Arthur Rondeel, Hengelo (NL); Laurens Hermannes Petrus Ezendam, Enter (NL)

(73) Assignee: HYCOM B.V., Apeldoorn (NL)

( * ) Notice: Subject to any disclaimer, the term of this patent is extended or adjusted under 35 U.S.C. 154(b) by 243 days.

(21) Appl. No.: 16/097,887

(22) PCT Filed: Mar. 20, 2017

(86) PCT No.: PCT/EP2017/000350
§ 371 (c)(1),
(2) Date: Oct. 31, 2018

(87) PCT Pub. No.: WO2017/190821
PCT Pub. Date: Nov. 9, 2017

(65) Prior Publication Data

US 2019/0135589 A1 May 9, 2019

(30) Foreign Application Priority Data

May 3, 2016 (DE) ..... 10 2016 005 477.8

(51) Int. Cl.
*B66C 13/02* (2006.01)
*B66D 1/50* (2006.01)
(Continued)

(52) U.S. Cl.
CPC ..... *B66C 13/02* (2013.01); *B66C 23/52* (2013.01); *B66D 1/50* (2013.01); *B66D 1/52* (2013.01); *B66D 1/525* (2013.01)

(58) Field of Classification Search
CPC ..... B66C 13/02; B66C 13/18; B66C 23/52; B66C 23/86; B66D 1/50; B66D 1/52; B66D 1/525
See application file for complete search history.

(56) References Cited

U.S. PATENT DOCUMENTS 3,653,636 A * 4/1972 Burrell ..... E21B 19/09 254/270
3,828,683 A * 8/1974 Lehrer ..... B63B 27/18 104/114
(Continued)

FOREIGN PATENT DOCUMENTS

DE 10 2005 058 952 10/2006
DE 10 2008 024 513 11/2009
(Continued)

OTHER PUBLICATIONS

International Search Report (ISR) dated Jun. 1, 2017 in International (PCT) Application No. PCT/EP2017/000350.

*Primary Examiner* — Michael E Gallion
(74) *Attorney, Agent, or Firm* — Wenderoth, Lind & Ponack, L.L.P.

(57) ABSTRACT

A compensating device (200) maintains specifiable target positions of a load (206) handled using a cable hoist (202) and attached to a cable (216) of the cable hoist. The respective specifiable target position of the load may change unintentionally to an actual position deviating from the target position. The compensating device has a sensor device (240, 242) for detecting the respective actual position of the load (206). A rotational drive (226, 228, 230) specifies a cable length of the cable hoist (202). A controller (244) changes the cable length after the respective actual position has been detected until the load (206) re-assumes its target position. The respective drive (226, 228,230) can be controlled at least partly by a hydraulic motor (226, 228, 230)
(Continued)

with opposite rotational directions. The motor is connected to an actuating device (246) having at least two separate pressure chambers (250, 252) with pressure levels that differ during operation, thereby forming a drive section (248) for the respective hydraulic motor (226, 228, 230), and which can be actuated by the controller (244).

20 Claims, 2 Drawing Sheets

(51) Int. Cl.
*B66C 23/52* (2006.01)
*B66D 1/52* (2006.01)

(56) References Cited

U.S. PATENT DOCUMENTS 3,971,545 A * 7/1976 Warman ..... B66D 1/20 254/273
4,324,385 A * 4/1982 Cojean ..... B63B 27/16 254/270
4,373,332 A * 2/1983 Holmen ..... B66D 1/52 254/291
5,058,451 A * 10/1991 Fujimoto ..... B60K 37/06 74/527
7,775,383 B2 * 8/2010 Ueki ..... B66D 1/52 212/308
9,908,756 B2 * 3/2018 Heravi ..... B66D 1/46
10,689,922 B2 * 6/2020 Taraldrud ..... E21B 19/008
2003/0123957 A1 * 7/2003 Jordan ..... E21B 19/006 414/138.2
2007/0272906 A1 * 11/2007 Davidson ..... B66D 1/525 254/270
2010/0263364 A1 * 10/2010 Tsutsui ..... F16H 61/4157 60/466
2010/0308289 A1 * 12/2010 Dalsmo ..... B66D 1/52 254/270
2012/0285152 A1 * 11/2012 Sugano ..... B66D 1/44 60/325
2013/0199168 A1 * 8/2013 Ankargren ..... F15B 1/02 60/327
2013/0311051 A1 * 11/2013 Torii ..... B66C 13/20 701/50
2013/0312979 A1 * 11/2013 Ankargren ..... B66C 13/02 166/355
2015/0266704 A1 * 9/2015 Jewell ..... B66C 13/18 414/803
2019/0047829 A1 * 2/2019 Martinsen ..... B66C 13/04
2019/0077641 A1 * 3/2019 Stensland ..... B66D 1/08
2019/0106301 A1 * 4/2019 Masuda ..... B66C 23/86
2020/0039615 A1 * 2/2020 Kristjansson ..... E21B 19/006
2020/0247647 A1 * 8/2020 Kanda ..... B66C 13/18

FOREIGN PATENT DOCUMENTS

JP 1-110498 4/1989
NL 8000582 8/1980
SU 958218 9/1982
WO 2005/090226 9/2005
WO 2009/038468 3/2009
WO 2014/062792 4/2014

* cited by examiner

COMPENSATING DEVICE FOR MAINTAINING SPECIFIABLE TARGET POSITIONS OF A HOISTED LOAD

FIELD OF THE INVENTION

The invention concerns a regenerative compensating device for maintaining specifiable target positions of a load that may be manipulated by a cable hoist. The load is attached to a cable of the hoist. The load may unintentionally change its specifiable target position into a deviating actual position due to interference factors. At least one sensor device provides the direct or indirect acquisition of the respective actual position of the load. A rotatory drive provides an effective cable length from the cable hoist. At least one control device that, after acquisition of the respective actual position of the load, changes the effective cable length until the load is again in its specified target position.

BACKGROUND OF THE INVENTION

A prior art solution to this end is depicted in part schematically in FIG. 1. The compensating devices are preferably used in instances where the lifting or lowering of a load attached to a load cable is required, using a common cable hoist. The load or material transport is naturally subject to interference factors such as increased wind loads, increased wave action or other interference factors like uneven floors or similar factor that can occur during operation of a cable hoist. The cable hoist may be a stationary installation, for example as part of a dockyard crane system, or is often moved in conjunction with a moveable machine or part of a cargo ship.

To transport the load, the respective cable hoist is provided with a cable winch of the commonly used kind, which cable winch is provided with a reversible electric or hydraulic motor that serves as rotating drive for winding and unwinding of the cable. If the described usual load lifting operation with its specifiable target positions of the load is now superimposed by the interference factors described earlier, for example, because a cargo ship fitted with a cable hoist is subjected to a more or less strong wave action, the load attached to the cable hoist through the cable would, without the known compensating device, follow the wave action in real time by assuming actual positions that deviate from the target positions, and may be damaged for example when lowered onto solid ground, such as a wharfage or the sea bed. Thus, the free lowering path of the load attached to the cable becomes shorter or longer, the effective length of which is defined by the free length of cable unwound from the cable drum as soon as the cargo ship follows the respective wave action with the cable hoist.

To solve this problem, the known solution, as shown schematically in FIG. 1, provides that the respective actual position of the load on the cable is acquired at least indirectly by a sensor device called in the industry "Motion Reference Unit" (MRU). After comparison of the actual position with the specified target position by a computer or control device, the effective cable length is shortened or extended, as required, by the compensating device. Part of the compensating device is an actuator, usually in form of a hydraulic cylinder with a piston rod, the free end of which is fitted with a rotatable guide pulley over which the cable coming from the cable winch extends. Through retracting or extending the piston rod, the effective cable length can be extended or shortened respectively so that a compensation of the described interference factors is possible in this manner.

The shortening or extension of the effective cable length depends exclusively on the travel distance when extending or retracting the piston rod unit so that for large deviations of the actual position from the target position a relatively long duty stroke of the power cylinder is required. To achieve this compensation, large hydraulic power cylinders including hydraulic pumps are therefore often used in practical applications, which require a correspondingly large installation space in the vicinity of the actual cable hoist. Due to the large amounts of hydraulic fluid required for the operation of the power cylinder by the hydraulic pump, which has to be circulated in the corresponding hydraulic circuit, the overall efficiency of the compensating device has to be rated as relatively low. Moreover, the cable is subjected to increased friction wear at least in the section in which the guide pulley of the power cylinder moves for the compensating process and the cable is redirected. Since a lot of time is required for each compensating retraction and extension move of the power cylinder, controlled by its hydraulic system, and since large quantities of fluid have to be moved, the known solution is not suitable to implement immediate compensation processes on the effective cable length. This lack of suitability impairs the operational and functional safety as well as the positioning accuracy. Due to its dimensions and weight, as well as its functionality, the known compensating device is basically only suitable for use on large equipment. Already existing plant or machine parts cannot be retrofitted with the known compensating device at a reasonable effort.

SUMMARY OF THE INVENTION

Based upon the prior art, an object of the invention to provide an improved compensating device that avoids the above-described disadvantages.

This object is basically met by a compensating device where the respective rotatory drive is controlled at least partially by at least one bi-directional hydraulic motor. The hydraulic motor is connected in a fluid-conducting manner to an actuating device that, while forming a drive for the respective hydraulic motor, is provided with at least two pressure chambers that are separated from one another, that are at different pressure levels during operation and that may be operated by the control device. A modern hydraulic motor drive concept is described for the directly driven cable winch of the cable hoist, where only small quantities of drive fluid need to be circulated to provide better efficiency and dynamic response compared to the drive concepts with hydraulic power cylinders as they are known from the prior art. Since the respective hydraulic motor does not have a separate cable guide, like the guide pulley used on the prior art power cylinder, but rather operates the rotatory drive of the cable winch of the cable hoist directly, for example, by a hydraulic clutch, or even forms its entire drive module, a low-wearing cable guide is achieved via the cable winch only, where the winch is required in any case. By using a correspondingly large winch diameter, cable friction can be reduced to minimise wear, particularly on the cable.

Since the hydraulic motor is directly controlled via the respective pressure chambers of the actuating device due to its direct coupling with the cable winch, the compensating actions required on the cable can be achieved without delay. The operational and functional reliability is then increased, as well the positioning accuracy of the compensating device according to the invention. Due to the modular design of the compensating device with its components, such as sensor and control devices including the hydraulic motor with its actuating device, it can easily be retrofitted to existing plants or equipment in a cost-effective manner and can be mounted directly at the cable hoist in the vicinity of the cable drum in a space-saving manner. This structure has no equivalent in the prior art.

In a particularly advantageous manner, the drive of the actuating device can be operated by at least one actuator. The at least two separated pressure chambers of the actuating device each have a fluid connection to the respective hydraulic motor in such a way that either the one or the other pressure chamber serves to drive the respective hydraulic motor in the one or the other rotational direction, respectively. The pressure chamber, which is currently not used to drive the respective hydraulic motor, will take up the displaced fluid for a subsequent discharge process when the drive is operated. The functional separation of the actuating device into a drive to drive the hydraulic motor and an actuator to drive the drive provides for the employment of different technical solutions for the design and sizing of the actuator. Besides a preferred implementation of the actuator in form of a hydraulically operated power cylinder, it may also be implemented through an electric motor or a hydraulic motor that operates a spindle drive.

In a particularly advantageous design, the control device is provided with at least one valve arrangement, which is used to control the actuator in contra-rotating directions using an operating pressure from a supply source. Compared to other drives, in particular electrical drives, the actuator designed as a fluid-driven, hydraulic power cylinder makes a rapid change of direction possible when controlling the drive of the actuating device.

In particularly advantageous exemplary embodiments, the sensor is provided with at least one gyroscope and/or inertia-based sensor and/or a satellite-based navigation device. Such sensors and devices can be obtained relatively cheaply, but are still sufficiently accurate to determine the respective load position with certainty. Sensors of this kind are often already on site, for example on board of a cargo ship, to monitor its orientation and position, making it possible to use the sensors to also acquire the position of the load suspended on the cable relative to the respective transportation.

In a preferred embodiment of the compensating device according to the invention, the drive and the actuator each are provided with at least one piston that is guided inside a common housing of the actuating device. The adjacently located pistons are operatively connected to each other via a coupling. Instead of providing a spatially separated arrangement of the drive of the actuating device for controlling the hydraulic motor through the actuator for operating and controlling the drive, which may also be in operative connection to each other via a hydraulic coupling, for example, they may preferably be combined in a common actuator housing in a space-saving manner. In this instance the coupling is preferably achieved mechanically via a common piston rod. This way, the drive as well as the actuator of the actuating device are provided as hydraulically operated power cylinders. This design provides a cost-effective and functionally reliable realisation of the compensating device.

In a further preferred embodiment of the compensating device according to the invention, the individual pistons of the piston rod unit, preferably with the same outer diameter, subdivide the housing of the actuating device into at least four pressure chambers with at least partially varying pressure levels and volumes that are assigned directly to the drive and the actuator. Since the respective pistons delimit the pressure chambers and are simultaneously displaceable by the piston rod unit into one or the other opposite direction, a change in pressure level transfers directly onto the piston movement, that is, onto the piston and piston rod and reverse, so that immediate control actions are possible for the hydraulic motor of the cable winch of the cable hoist.

In a particularly preferred embodiment of the compensating device according to the invention, an additional pressure chamber of the actuating device is preloaded by an energy store, such as a hydraulic accumulator, with the objective to move the drive with the actuator in a specifiable movement direction and to establish a force equilibrium at the drive. When certain interference factors influence the overall facility, the released fluid volume is stored via the additional pressure chamber with its connected hydraulic accumulator to be reused in a subsequent process step. Particularly when starting up the cable winch under high load, or when interference factors influence the overall facility, the additional pressure chamber with its connected hydraulic accumulator ensures a jerk-free operation and causes a corresponding damping effect in the overall movement of the hydraulic motor in its operation of the attached cable winch by damping the piston rod unit of the actuating device in its respective displacement movement.

As described above, it is possible to store a certain volume of fluid, which may also be of advantage for other pending solutions with devices of this kind. One advantage of a drive with a rotatory cable winch is the possibility of combining one or more variable displacement motors into a single drive unit in order to achieve the required cubic capacity in operation. This arrangement also opens up the possibility to approximate the required load pressure difference to the pressure inside the accumulator, leading to an increase in the overall efficiency while minimising the required actuator power.

A fixed, optimal accumulator pressure may insofar be preselected. At heavy loads, the entire cubic capacity of the respective rotatory drive is adjusted upwards. At light loads, on the other hand, it is adjusted downwards, but always so that the load pressure is able to approximate the accumulator pressure equalisation. This arrangement has the advantage that it is not necessary to correct the accumulator pressure during the lifting process with pending load changes, for example, due to the mass of the reeled-off cable length or due to buoyancy when the attached load passes through the water surface. The installed accumulator energy can always be fully utilised. A smaller rotatory displacement is required for lighter loads. More compensated revolutions can be achieved at the cable winches with the same accumulator volume. In that way, lighter loads can be corrected over longer traversing paths.

In a further preferred embodiment of the compensating device according to the invention, the one pressure chamber of the actuating device is operated in a high-pressure mode. In contrast at least one other pressure chamber of the drive means is operated in a low-pressure mode. Although when the compensating device is in operation, the operating pressure in low-pressure mode can rise significantly, and that of the high pressure mode is reduced accordingly, such a subdivision makes particularly the lifting of the load by the cable hoist easier since an increased drive torque is provided in this manner. Preferably, the pressure chamber, which is mainly operated in low-pressure mode, is preferably connected permanently to a low-pressure accumulator. In this manner it is possible to correct the operating fluid volume and the pressure for the pressure chambers of the actuating device so that the hydraulic components for the cable winch drive are supplied with a sufficient amount of fluid, even during the dynamic reversing operation.

In a further particularly preferred embodiment of the compensating device according to the invention, the actuating device is provided with a position sensor, which makes it possible to acquire the position of the actuator and/or the drive. The controller controls the respective actuator under consideration of the position by a processor unit. Since the position of the piston rod unit of the actuating device can be detected by the sensor, the controller with associated processor unit is able to acquire the current actual position of the piston rod unit and use it for a control process to correct the actual load position towards the respective target load position.

In a further preferred embodiment of the compensating device according to the invention, the respective hydraulic motor can be accelerated and decelerated in both contra-rotating directions through a hydraulic driving and braking unit, which is superimposed upon the application of pressure by the respective pressure chamber of the drive. In this manner the major part of the load lifting and lowering process with the cable winch can be achieved through the driving and braking unit. The additional hydraulic motor has exclusively the function of undertaking the compensating processes for maintaining the target load position. The hydraulic motor may then be sized correspondingly small and requires only small amounts of fluid volume for the compensating and reversing operation of the cable winch. The actuating device with its drive and pressure chambers with different pressure levels then also needs to supply only small amounts of operating fluid volume to effectively operate the compensating hydraulic motor.

The cable hoist may be installed fixed, in particular be part of a dockyard crane system, or it is part of an installation location that is subjected to interference factors, in particular a floating transport that is subject to wave action, in particular in form of a ship or a conveyor platform. Moreover, the compensating device may be used in vehicles that are fitted with at least comparable cable hoists, such as mobile cranes, cable-operated forklifts or other lifting devices.

Other objects, advantages and salient features of the present invention will become apparent from the following detailed description, which, taken in conjunction with the drawings, discloses a preferred embodiment of the present invention.

BRIEF DESCRIPTION OF THE DRAWINGS

Referring to the drawings that form a part of this disclosure that are schematic and not to scale.

DETAILED DESCRIPTION OF THE INVENTION

Figure 1:
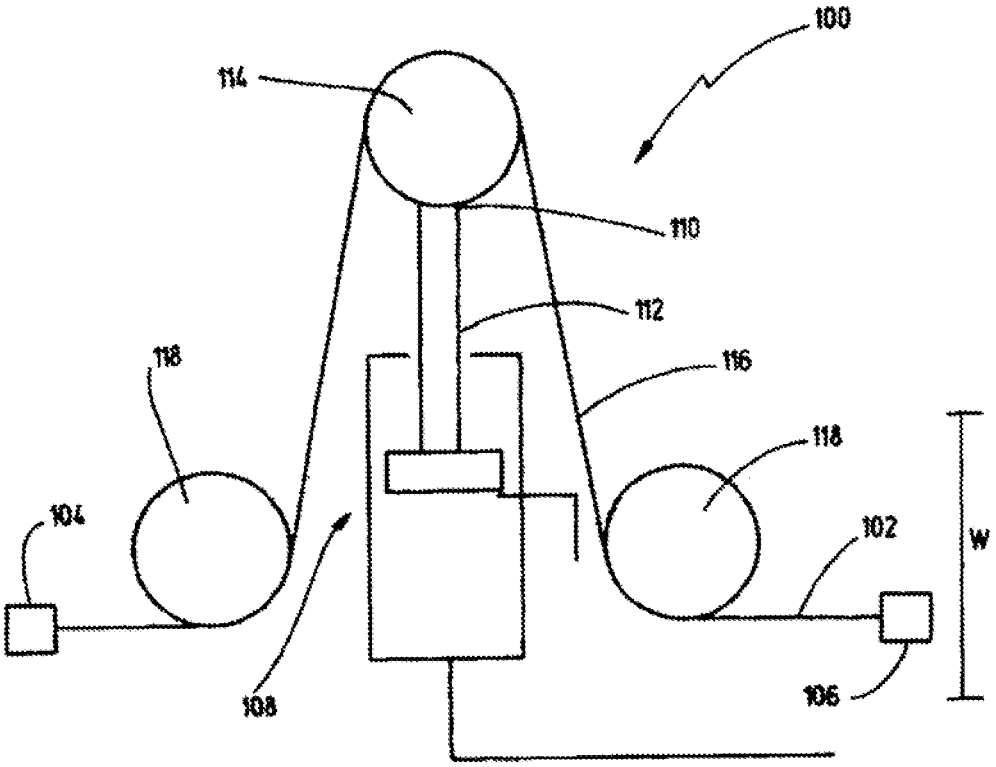
Fig.1 PRIOR ART
FIG. 1 is a schematic side view of a prior art compensating device, which comprises a hydraulic power cylinder with a guide pulley at the end to guide a cable.

A section of a prior art compensating device 100 is depicted in FIG. 1. That device is usually disposed in a cable hoist 102 between a cable winch 104 and a load 106 to be lifted. The compensating device 100 comprises a piston/cylinder unit 108. A guide pulley 114 is attached at the free end 110 of the piston rod 112. With this compensating device 100, it is possible to deflect the cable 116 by a certain amount upwards or downwards through the traversing path of the piston rod 112. Pulleys 118 for the cable 116 are disposed before and after the piston/cylinder unit 108. By suitably controlling the piston/cylinder unit 108, the effective length of the cable 116 can be reduced after the compensating device 100 through extending the piston rod 112. The cable length can be extended again through retracting the piston rod 112. This device makes it possible to compensate to a limited extent for any interference factors, which may be caused by wind loads or wave action, although a relatively large expense for equipment and controls is required, not to mention wear and tear on the cable 116.

Figure 2:
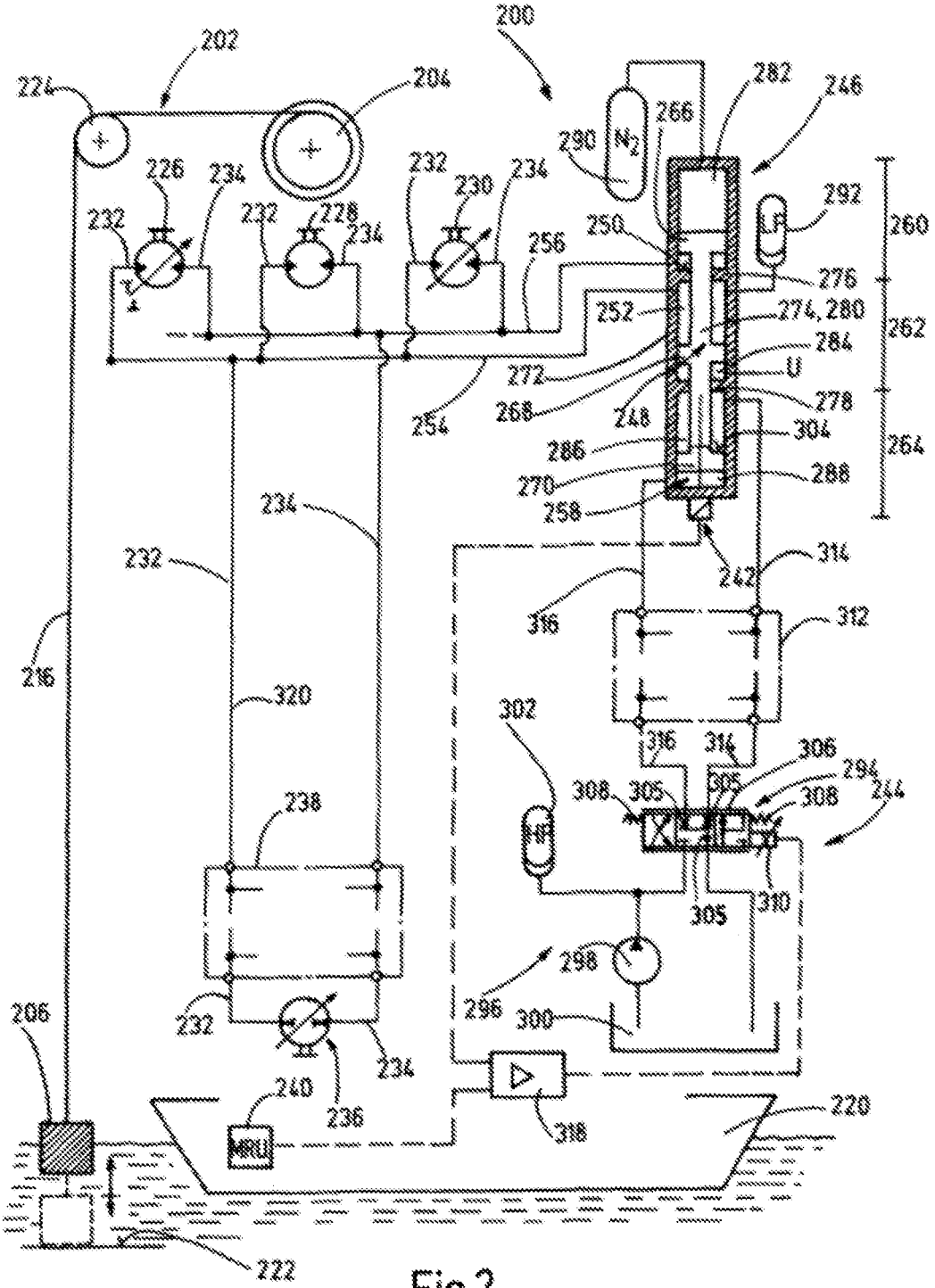
FIG. 2 a schematic hydraulic circuit diagram of a compensating device according to an exemplary embodiment of the invention, as part of a cable hoist on a cargo ship.

FIG. 2 depicts a compensating device 200 according to the invention that is improved compared to the above-described prior art compensation device 100. The compensating device 200 is provided to maintain specifiable target positions of a load 206 that is manipulated by a cable hoist 202 and a cable 216 attached to the load 206. Interference factors unintentionally change the specifiable target position of the load 206 into an actual position that deviates from the target position.

In this example, the cable hoist 202 is part of an installation location 220 that is subject to interference factors, in particular a floating transport in form of a ship that is subject to wave action. The cable hoist 202 is provided as part of the structure of the ship 220 and serves for the lifting and lowering of the load 206 from/to the sea floor 222. The cable hoist 202 is provided with a cable winch 204 onto which the cable 216 can be wound on and off again. Starting from the cable winch 204, the cable 216 extends via a pulley 224 to the load 206. As is common practice, multiple pulleys and booms as well as hooks or other coupling devices may be provided as part of the cable hoist 202, which have not been included in this schematic hydraulic circuit diagram for reasons of simplification.

The cable winch 204 may be operated with a hydraulic motor 226, 228, 230 in one rotational direction and in the opposite rotational direction. As an example, FIG. 2 depicts three hydraulic motors 226, 228, 230 in total. Of these at least one is always provided to drive the cable winch 204. The hydraulic motors 226, 228, 230 differ from each other in their displacement. The hydraulic motor 228, depicted in the centre of the diagram, has a fixed displacement. The hydraulic motor 226 shown on the left has a graduated displacement. The hydraulic motor 230 on the right has an infinitely variable displacement. Each of the hydraulic motors 226, 228, 230 is connected via two fluid lines 232, 234 to a hydraulic pump 236, which is operated in four-quadrant mode. A safety device 238 may be connected in the fluid lines 232, 234 between the hydraulic pump 236 and the respective hydraulic motor 226, 228, 230, which is provided with valves and/or sensors for the reliable control of the cable hoist 202.

The raising and lowering of the load 206 is possible with the cable hoist 202 described so far. The problem is, however, that the position and orientation of the cargo ship 220 can change due to wave action or wind loads. The changed orientation or position would be transferred via the cable hoist 202 to the load 206, so that the load also constantly changes its position and in particular its height above the sea floor 222. Thus, the precise dropping of a load 206 to the sea floor 222 is made very difficult, if not impossible.

To remedy this problem, the compensating device 200 according to the invention is provided. The compensating device 200 comprises a sensor device or sensor 240, 242 for the direct or indirect acquisition of the respective actual position of load 206. The rotatory drive in form of the cable winch 204 is driven by the respective hydraulic motor 226, 228, 230, for paying out an effective cable length of the cable hoist 202. A control device or control 244, after acquisition of the respective actual position of the load, changes the effective cable length until the load 206 has regained its specified target position again. According to the invention, the rotatory drive may be controlled by a contra-rotating hydraulic motor 226, 228, 230, each having a fluid connection to an actuating device or actuator 246. While forming a drive means or drive 248 for the respective hydraulic motor 226, 228, 230, the actuating device or actuator 246 comprises at least two pressure chambers 250, 252 being separated from each other with different pressure levels when in operation, and being controlled by the control device 244.

The actuating device 246 is connected parallel to hydraulic pump 236 via corresponding fluid lines 254, 256 to the hydraulic motor 226, 228, 230, depending on which one will come into operation. The respective hydraulic motor 226, 228, 230 may be accelerated or decelerated, respectively, in both contra-rotating directions, superimposed by the pressure applied from the respective pressure chamber 250, 252 of drive means or actuator drive 248 and by a hydraulic driving and braking unit in form of a hydraulic pump 236 of the cable hoist 202.

The actuating device 246 is implemented as a triple-piston with a drive means 248 and an actuator or drive actuator 258. The actuating device 246 is subdivided overall into three sections 260, 262, 264 of which in the drawing the upper section 260 is called the high-pressure section, the centre section 262 is called the low-pressure section and the lower section 264 is the actuator section. Each section 260-264 is provided with a piston 266, 268, 270 within a common, pressure-resistant housing 272. The pistons 266, 268, 270 are connected and separated from each other by a common piston rod 274. The sections 260-264 are separated from each other leak-proof through the separating walls 276, 278. The piston rod 274 passes through the separating walls 276, 278. The drive means 248 and the actuator 258 each are then provided with a piston 266, 268, 270 that is guided in the common housing 272 of the actuating device 246. The adjacent pistons 266, 268, 270 are in operative connection with each other via a coupling device in form of the piston rod 274. The coupling device 274 in form of the piston rod forms, together with the respective pistons 266, 268, 270 that are guided inside housing 272 of the actuating device 246, the piston rod unit 280 as a whole. The pistons 266, 268, 270 of the piston rod unit 280 subdivide, preferably with the same outside diameter, the housing 272 of the actuating device 246 into a total of six pressure chambers 250, 252, 282, 284, 286, 288.

Two of the separated pressure chambers 250, 252 of the actuating device 246 each have a fluid connection to the associable hydraulic motors 226, 228, 230 in such a way that either the one or the other of the pressure chambers 250, 252 serves to drive the respective hydraulic motor 226, 228, 230 in the one direction or the other contra-rotating direction. The pressure chamber 250, 252 that is not engaged in driving the respective hydraulic motor 226, 228, 230 takes up the fluid, which was displaced by this driving process, for a subsequent discharge process. The additional pressure chamber 282 of the drive means 248 of the actuating device 246 is preloaded by an energy store 290 in form of a container and biases the piston rod unit 280 with the actuator 258 to move into a specifiable movement direction. To this end the pressure chamber 282 and the energy store 290 are filled with an operating gas in form of nitrogen ($N_2$) with specified preloading. The additional pressure chamber 282 of the actuating device 246 can then be operated in a kind of high-pressure mode. In contrast another additional pressure chamber 284 of the drive means 248 is operated in a kind of low-pressure mode and is open to the environment U. A low-pressure store 292 is connected permanently to pressure chamber 252. This low-pressure store 292 has the purpose to maintain a sufficiently high pressure level in pressure chamber 252 and in the fluid line 254 and to prevent possible cavitation.

The drive means 248 of the actuating device 246 may be operated by the actuator 258. A control device 244 with a valve device 294 or valve is provided for controlling the actuator 258. With valve device 294 a supply pressure of a supply unit 296 can be applied to the actuator 258 in opposite movement directions. The supply unit 296 comprises a hydraulic pump 298, which draws hydraulic fluid from a tank 300. A hydro-pneumatic pressure store 302 is inserted between the hydraulic pump 298 and the valve device 294 as equalisation buffer. The valve device 294 takes the form of a 4/3-way proportional valve. In the left switch position of the valve device 294, as shown in the drawing, the hydraulic pump 298 feeds fluid into a rod-side pressure chamber 286 of the actuator 258, while fluid is able to flow away from the opposite, piston-side pressure chamber 288 in the direction of the tank 300. In this left side switch position, the piston rod unit 280 is lowered inside the housing. In the right switch position, both pressure chambers 286, 288 of the actuator 258 are supplied with hydraulic fluid. Due to the pressure-active area at the rod-side 304 of piston 270 of the actuator 258, this leads to a lifting of the piston rod unit 280. In the central neutral position, both pressure chambers 286, 288 of the actuator 258 have a fluid connection to each other via a restrictors 305 as well as with the tank 300 via a restrictor 305. The actuator 258 is inactive in this switch position. The valve piston 306 of the valve device 294 is centred in its middle neutral position via springs 308 provided at the valve piston ends. In order to set the required switch positions of the valve piston 306 with the control device 244, an electromagnetic operating device 310 is provided.

A safety device 312 is additionally installed in the fluid lines 314, 316 between the valve device 294 and the actuator 258. The safety device is provided with further sensors and/or valves for controlling the actuator 258.

The control device 244 is coupled to the two sensor devices 240, 242. The one or first sensor device 240 comprises a gyroscope or inertia-based sensor, in particular an acceleration sensor as well as, where necessary, an additional satellite-based position acquisition device. This sensing facility makes it possible to determine the position and orientation of the cable hoist 202, and thus, indirectly the actual position of the load 206. The actuating device 246 comprises a further or second sensing device 242 in form of a position sensing device 242 with which the position of the piston rod unit 280 within the actuator 258 and that of the drive means 248 can be determined. By a processor unit or processor 318, the control device 244 controls the actuator 258 under consideration of the position and orientation data.

The compensating device 200 according to the invention acts in parallel to the hydraulic pump 236 of the cable hoist 202 of the respective hydraulic motor 226, 228, 230 of the cable winch 204. The hydraulic fluid of a hydraulic circuit 320 of the cable hoist 202 may be fed into a corresponding pressure chamber 250, 252 of the drive means 248 of the actuating device 246 of the compensating device 200. Its pressure-based energy may be stored temporarily in the corresponding energy store 290, 292. In the opposite operating direction, the energy may be released from the energy stores 290, 292 from the actuating device 246 in order to decelerate and accelerate the respective hydraulic motor 226, 228, 230 of the cable hoist 202. Moreover, the drive means 248 of the actuating device 246 may be operated by the actuator 258 so as to selectively control the deceleration or acceleration of the hydraulic motor 226, 228, 230 of the cable hoist 202 to compensate for the interference factors. The actuator 258 is controlled by the control device 244 in conjunction with the position and orientation information of the cable hoist 202 and the piston rod unit 280 inside the actuating device 246, which has been acquired with the sensor devices 240, 242.

The solution according to the invention proposes a modern hydraulic motor drive concept for the directly drivable cable winch 204 of the cable hoist 202 with small quantities of operating or drive fluid, which exhibits a greater degree of efficiency than the drive concepts using hydraulic power cylinders 108 as per the prior art. Since the respective hydraulic motor does not have its own cable guide, for example, the above-described guide pulley 114 on power cylinder 108, but rather acts directly on the rotatory drive 226, 228, 230 of the cable winch 204 of the cable hoist 202, for example by a hydraulic clutch, or forms its drive module entirely, it is possible to achieve a low-wearing cable guidance solely through the already necessary cable winch 204. By using a correspondingly large winch diameter, the cable friction may be further reduced so as to minimise wear in particular on cable 216.

While one embodiment has been chosen to illustrate the invention, it will be understood by those skilled in the art that various changes and modifications can be made therein without departing from the scope of the invention as defined in the claims.

The invention claimed is:

1. A compensating device for maintaining specifiable target positions of a load that is subject to manipulation by a cable hoist, that is attached to a cable of the cable hoist and that unintentionally changes a respective specifiable target position into an actual position deviating from the specifiable target position due to interference factors, the compensating device comprising:

a sensor capable of directly or indirectly acquiring the actual position of the load;

a rotatory drive capable of setting an effective length of a cable of the cable hoist;

a control capable of changing an effective length of the cable returning the load to the specifiable target position of the load;

a first hydraulic motor controlling the rotary drive in opposite first and second rotational directions, the hydraulic motor having a first fluid connection; and an actuator being connected in fluid communication to the first fluid connection and forming an actuator drive for the first hydraulic motor, the actuator drive having first and second pressure chambers separated from each other and having different pressure levels in operation, the actuator being operably controlled by the control, the actuator driving having a third pressure chamber being separated from the first and second pressure chambers and being operated in a higher pressure mode relative to the first and second pressure chambers, the second pressure chamber being permanently connected in fluid communication to a low-pressure store, the lower-pressure store being a hydraulic accumulator.

2. A compensating device according to claim 1 wherein the actuator drive is operable by a drive actuator;

the first and second pressure chambers each have a fluid-conducting connection to the first hydraulic motor, with the first pressure chamber driving the hydraulic motor in the first rotational direction while the second pressure chamber receives fluid discharged from the first hydraulic motor to be subsequently discharged therefrom, the second pressure chamber driving the first hydraulic motor in the second rotational direction while the first pressure chamber receives fluid discharged from the first hydraulic motor to be subsequently discharged therefrom.

3. A compensating device according to claim 2 wherein the control comprises a valve in fluid communication with and controlling the drive actuator to rotate the first hydraulic motor in the first or second rotational direction using an operating pressure from a supply source connected in fluid communication with the first hydraulic motor.

4. A compensating device according to claim 1 wherein the sensor comprises at least one of a gyroscope, an inertia-based sensor or a satellite-based navigation device.

5. A compensating device according to claim 2 wherein each of the actuator drive and the drive actuator comprises a piston being guided for movement inside a common housing of the actuator and being connected to each other via a coupling.

6. A compensating device according to claim 5 wherein the coupling device comprises a piston rod extending between the pistons.

7. A compensating device according to claim 6 wherein the piston rod is fixedly connected to said pistons for simultaneous movement thereof.

8. A compensating device according to claim 1 wherein The actuator comprises first, second and third pistons connected by a piston rod and guided for movement inside a common housing, walls of said housing and the piston defining the first, second and third pressure chambers and defining fourth, fifth and sixth pressure chambers, each of the pressure chambers having at least partially varying pressure levels and volumes and being assigned directly to the actuator drive and the drive actuator.

9. A compensating device according to claim 8 wherein each of the pistons has an equal outer diameter.

10. A compensating device according to claim 2 wherein the third pressure chamber and a fourth pressure chamber form the hydraulic accumulator for the actuator drive and the drive actuator.

11. A compensating device according to claim 2 wherein the actuator has a position sensor acquiring a position of the actuator drive and/or the actuator drive; and the control controls the drive actuator based on the position acquired by the position sensor by a processor.

12. A compensating device according to claim 1 wherein the first hydraulic motor is accelerated and decelerated in both of the first and second rotational positions by a hydraulic driver and brake superimposed upon pressure applied by the respective one of the first and second pressure chambers.

13. A compensating device according to claim 1 wherein the cable hoist is fixedly mounted on a dock or a floating transport subjected to the interference factors.

14. A compensating device for maintaining specifiable target positions of a load that is subject to manipulation by a cable hoist, that is attached to a cable of the cable hoist and that unintentionally changes a respective specifiable target position into an actual position deviating from the specifiable target position due to interference factors, the compensating device comprising:

a sensor capable of directly or indirectly acquiring the actual position of the load;

a rotatory drive capable of setting an effective length of a cable of the cable hoist;

a control capable of changing an effective length of the cable returning the load to the specifiable target position of the load;

a first hydraulic motor controlling the rotary drive in opposite first and second rotational directions, the hydraulic motor having a first fluid connection; and an actuator being connected in fluid communication to the first fluid connection and forming an actuator drive for the first hydraulic motor, the actuator drive having first and second pressure chambers separated from each other and having different pressure levels in operation, the actuator being operably controlled by the control, the actuator drive is operable by a drive actuator, the first and second pressure chambers each having a fluid-conducting connection to the first hydraulic motor, with the first pressure chamber driving the hydraulic motor in the first rotational direction while the second pressure chamber receives fluid discharged from the first hydraulic motor to be subsequently discharged therefrom, the second pressure chamber driving the first hydraulic motor in the second rotational direction while the first pressure chamber receives fluid discharged from the first hydraulic motor to be subsequently discharged therefrom.

15. A compensating device according to claim 14 wherein the control comprises a valve in fluid communication with and controlling the drive actuator to rotate the first hydraulic motor in the first or second rotational direction using an operating pressure from a supply source connected in fluid communication with the first hydraulic motor.

16. A compensating device according to claim 14 wherein each of the actuator drive and the drive actuator comprises a piston being guided for movement inside a common housing of the actuator and being connected to each other via a coupling.

17. A compensating device according to claim 16 wherein the coupling device comprises a piston rod extending between the pistons.

18. A compensating device according to claim 17 wherein the piston rod is fixedly connected to said pistons for simultaneous movement thereof.

19. A compensating device for maintaining specifiable target positions of a load that is subject to manipulation by a cable hoist, that is attached to a cable of the cable hoist and that unintentionally changes a respective specifiable target position into an actual position deviating from the specifiable target position due to interference factors, the compensating device comprising:

a sensor capable of directly or indirectly acquiring the actual position of the load;

a rotatory drive capable of setting an effective length of a cable of the cable hoist;

a control capable of changing an effective length of the cable returning the load to the specifiable target position of the load;

a first hydraulic motor controlling the rotary drive in opposite first and second rotational directions, the hydraulic motor having a first fluid connection;

an actuator being connected in fluid communication to the first fluid connection and forming an actuator drive for the first hydraulic motor, the actuator drive having first and second pressure chambers separated from each other and having different pressure levels in operation, the actuator being operably controlled by the control, the actuator including first, second and third pistons connected by a piston rod and guided for inside a common housing, walls of said housing and the piston defining the first, second and third pressure chambers and defining fourth, fifth and six pressure chambers, each of the pressure chambers having at least partially varying pressure levels and volumes and being assigned directly to the actuator drive and the drive actuator.

20. A compensating device according to claim 19 wherein each of the pistons has an equal outer diameter.

* * * * *